United States Patent [19]

Eberle

[11] Patent Number: 4,779,717

[45] Date of Patent: Oct. 25, 1988

[54] METHOD AND APPARATUS FOR GRIPPING, CONVEYING AND RELEASING PRINTED PRODUCTS

[75] Inventor: Jürg Eberle, Hinwil, Switzerland

[73] Assignee: SFT AG Spontanfördertechnik, Werk Dürnten, Dürnten, Switzerland

[21] Appl. No.: 21,160

[22] Filed: Mar. 3, 1987

[30] Foreign Application Priority Data

Apr. 29, 1986 [CH] Switzerland ..... 1756/86

[51] Int. Cl.[4] ..... B65H 29/04

[52] U.S. Cl. ..... 198/803.8; 198/803.9; 101/408; 271/204

[58] Field of Search ..... 198/803.7, 803.8, 803.9, 198/803.1; 271/204–206, 272, 275, 277; 101/408–411, 415.1

[56] References Cited

U.S. PATENT DOCUMENTS

| | | | |
|---|---|---|---|
| 4,072,228 | 2/1978 | Honegger et al. | 198/803.7 X |
| 4,276,978 | 7/1981 | Deguchi et al. | 271/204 X |
| 4,320,894 | 3/1982 | Reist et al. | 271/204 X |
| 4,381,056 | 4/1983 | Eberle | 271/204 X |
| 4,424,965 | 1/1984 | Faltin | 271/204 X |
| 4,448,408 | 5/1984 | Faltin | 271/204 X |
| 4,577,855 | 3/1986 | Reist | 271/204 X |
| 4,629,176 | 12/1986 | Ceelen | 271/204 |

FOREIGN PATENT DOCUMENTS

| | | | |
|---|---|---|---|
| 0033300 | 8/1981 | European Pat. Off. | 271/204 |
| 538065 | 7/1973 | Switzerland . | |
| 592562 | 10/1977 | Switzerland . | |

*Primary Examiner*—Robert J. Spar
*Assistant Examiner*—Lyle Kimms
*Attorney, Agent, or Firm*—Walter C. Farley

[57] ABSTRACT

For grasping, conveying and releasing printed products, particularly those occurring in a stream or scale flow by means of an endless link chain (90), a method is proposed, together with an apparatus having gripping and clamping members (10) for performing this method. For gripping and release purposes the individual gripping and clamping member (10) is so operated by means of control runner (70, 70') (75, 75') that a springy clamping arm (24) pressing under pretension against a bearing arm (16) is raised relative to the latter out of a closed position into an open position for grasping printed sheet (D) and then for conveying purposes is returned in snap-like manner into the closed position by the restoring force of clamping arm (24). The individual gripping and clamping member (10) operatively connected to articulation (92) of link chain (90) is constructed in one piece and has a substantially hairpin-like shape, which is bent four times.

12 Claims, 2 Drawing Sheets

METHOD AND APPARATUS FOR GRIPPING, CONVEYING AND RELEASING PRINTED PRODUCTS

BACKGROUND OF THE INVENTION

The invention relates to a method and an apparatus for gripping, conveying and releasing printed products, particularly those occurring in a stream or scale flow by means of an endless link or roller chain driven in revolving manner and gripping and clamping members operatively connected thereto.

Swiss Pat. No. 592 562 discloses a conveyor for printed products or the like occurring in a stream or scale flow, in which are provided on a revolving tension member (link chain) spaced grippers having an upper and a lower clamping tongue. In this apparatus, the individual grippers are brought up to the stream formation in such a way that the upper clamping tongue engages over the edge of the copy to be grasped and subsequently, as a result of a rotary movement, the lower tongue is swung under the edge of the copy. The two clamping tongues are then brought into the closed position either by pressing the gripper against a substrate or by spring tension.

The prior art also includes three-dimensional modern link chains, which can be driven and moved at a relatively high speed (e.g. Swiss Pat. No. 538 065), which are suitable for overcoming topologically difficult conveying paths and which comprise a plurality of operatively interconnected chain links, which are mounted in spherical segment-like articulations.

An object of the invention is to provide a method and an apparatus for performing it, whilst using an endless link chain, particularly the aforementioned modern, three-dimensionally movable endless link chain, far functionally picking up at relatively short intervals corresponding printed products at a transfer point, conveying them over difficult path configurations and automatically releasing the same at the predetermined delivery point.

The inventive method is characterized in that a single gripping and clamping member in the vicinity of a transfer and delivery point is so operated by correspondingly arranged and associated control members that for gripping and releasing the individual printed product at least one springy clamping arm is raised relative to a bearing arm and, for conveying purposes, on leaving the control members is returned by the springy restoring force in snap-like manner into the closed position.

The inventive apparatus for performing the method comprise gripping and clamping members arranged on an endless link chain and operatively connected thereto, characterized in that the individual gripping and clamping member is constructed in one piece and has a central fixing arm, a bearing arm located on one side with respect thereto and a spring arm arranged on the other side with respect thereto, as well as a clamping arm engaging under pretension on the bearing arm in the closed position, the spring arm with the clamping arm being transferable by suitable control means from the closed position into an open position and returnable to the closed position again by the springy restoring force of the spring arm.

BRIEF DESCRIPTION OF THE DRAWINGS

The invention is described in greater detail hereinafter relative to non-limitative embodiments and the attached drawings, which show.

DESCRIPTION OF THE PREFERRED EMBODIMENT

Figure 1:
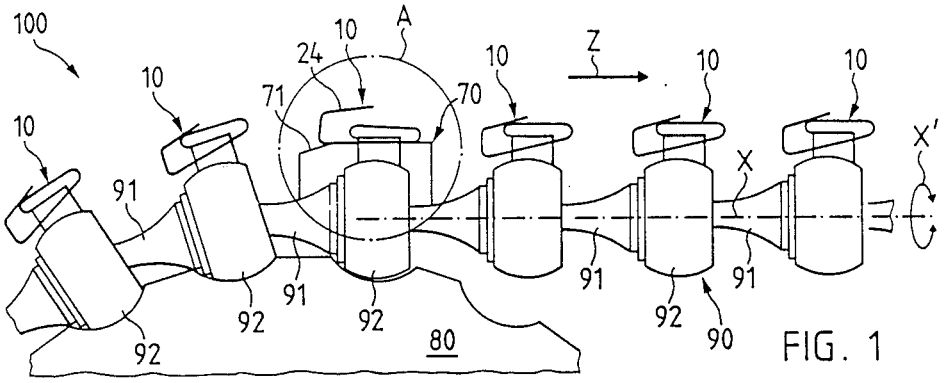
FIG. 1, a diagrammatically shown portion of a conveyor means with link chain for grasping, conveying and delivering flat articles.

FIG. 1 is a diagrammatic side view of a portion of a conveyor means 100 for grasping and conveying on flat articles, e.g. for grasping and conveying printed articles from a not shown, orderly scale or stream flow by means of an endless link chain 90 having correspondingly constructed and arranged gripping and clamping members 10.

The per se known link chain 90, which is tension and compression loadable and constructed as a three-dimensional link chain comprises a plurality of operatively interconnected chain links 91 with spherical segment-like articulations 92 and which permits the conveying of printed products. At a not shown transfer point between first and second conveyor belts the printed products are grasped by gripping and clamping members 10 and are released at an also not shown delivery point.

The course of the link chain 90 guided by means of guide members and in FIG. 1 in not shown single or twin chain channels is largely independent of its topographical and spatial orientation, as well as its length-dependent dimensioning. The guide members are e,g, constituted by sprocket-like guide or return pulleys 80, as diagrammatically shown in FIG. 1.

By means of a correspondingly constructed and arranged, not shown chain drive, link chain 90 is driven in substantially revolving manner in the direction of arrow Z. By suitable control means, link chain 90 can be rotated about its longitudinal axis X in the direction of arrow X', so that the gripping and clamping members 10 operatively connected to chain links 91 can also be rotated with respect to the position thereof.

Figure 2:
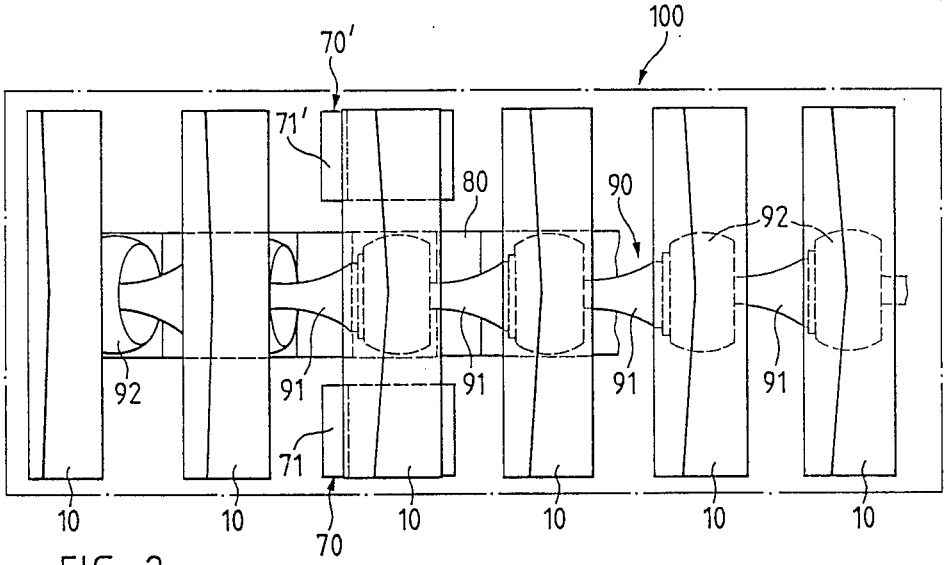
FIG. 2, the conveyor means according to FIG. 1 in plan view.

FIG. 2 shows the conveyor means 100 in plan view and it is possible to see in part the guide pulley 80, the link chain 90 with spaced chain links 91 and gripping and clamping members 10 operatively connected thereto. In the vicinity of the transfer point and preferably on either side of link chain 90, there are runner-like control members 70, 70' acting in slotted link-like manner and they can be fixed to the conveyor means 100 or need not be fixed and e.g. turn with the guide pulley 80 and consequently during the movement of link chain 90 the individual gripping and clamping members are successively operated.

The operation of control members 70, 70' will be described hereinafter relative to FIG. 3.

When link chain 90 moves in the direction of arrow Z, each gripping and clamping member 10 fixed to articulation 92 of link chain 90 engages with the two control members 70, 70'. Spring arm 20 runs against sloping abutting surface 71, 71' and is subsequently conveyed over the sliding surface 72.

During this process, the springy parts 20, 24 are forcibly moved out of a basic position (broken lines of parts 20, 24 in FIG. 3) in the direction of arrow H until part 20, acting as a spring arm, bears on sliding surface 72 of control member 70. In this position the gripping and clamping member 10 is in the open position and is moved on in the direction of arrow Z, so that a printed product, e.g. a folded newspaper, magazine or the like designated by the reference D either passes in the manner shown in FIG. 3 with part B or a not shown collar or fold into a gap S formed between part 24 acting as the clamping arm and a bearing arm 16 acting as the sliding and clamping face. Through the conveying movement of the gripping and clamping member 10 in the direction of arrow Z, printed sheet D is inserted in the direction of arrow Y into gap S up to the inner edge 22' of a web 22, a clearly defined stop for the printed product. As soon as spring arm 20 has reached the trailing edge 74 of control member 70 and is out of engagement with sliding surface 72, as a result of the restoring force of spring arm 20, clamping arm 24 is pressed in snap-like manner against bearing arm 16, whilst enclosing the newspaper D.

On moving link chain 90 in the direction of arrow Z, each gripping and clamping member 10 is opened by running over control member 70, 70' and then closed again in snap-like manner, whilst securing the printed product D or the like.

Figure 3:
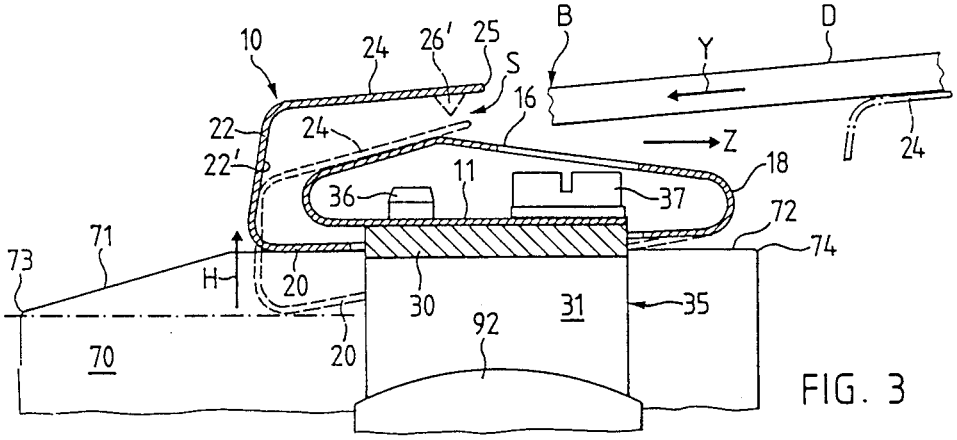
FIG. 3, the detail in a circle A in FIG. 1 on a larger scale of a gripping and clamping member operatively connected to the link chain in the open position.

The individual gripping and clamping member 10 is, as shown in FIG. 3, is arranged with its fixing arm 11 on a support member 35 connected operatively in not shown manner with articulation 92, is centered by a pin 36 and simultaneously rotation thereof is prevented, whilst being detachably fixed by fixing means, e.g. by a screw 37. Conveying direction Z is obviously also reversible and can therefore also take place in the other direction.

Figure 4:
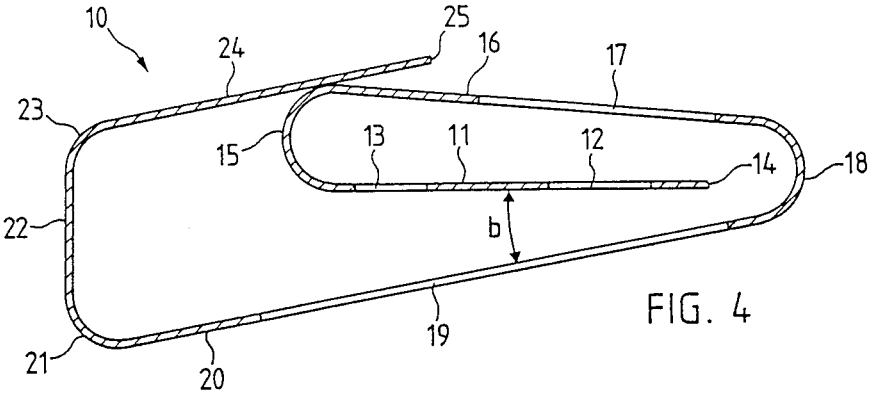
FIG. 4, a gripping and clamping member in profile cross-section shown as a larger scale detail.

FIG. 4 shows on a larger scale and in profile cross-section, the preferably one-piece gripping and clamping member 10, which is bent over in hairpin-like manner four times by means of curved parts 15, 18, 21 and 23 and which comprises the horizontally oriented fixing arm 11 with openings 12, 13, bearing arm 16 with openings 17 arranged in spaced manner above the same, which slopes and is constructed as a sliding part, spring arm 20 with recess 19 in the form of an elongated hole arranged below fixing arm 11 and sloping relative thereto, web 22 arranged substantially at right angles thereto, as well as clamping arm 24.

Gripping and clamping member 10 bent partly in hairpin-like manner four times is made in one piece from suitable spring steel. Fixing arm 11 essentially forms the base to which are successively connected a product bearing arm 16 with a curved part 15, a spring arm 20 with a curved part 18, a product stop web 22 with a curved part 21 and a clamping arm 24 with a curved part 23. Bearing arm 16 constructed as a sliding surface slopes to one side with respect to fixing arm 11. With respect to fixing arm 11, spring arm 20 slopes to the other side under an acute angle b, whilst forming an adequate lift freedom and recovery force and to which is connected web 22 substantially at right angles thereto.

Clamping arm 24 connected to curved part 23 is positioned substantially parallel and spaced with respect to spring arm 20 and is pressed by a corresponding initial stressing force against curved portion 15 or bearing arm 16. According to a preferred embodiment of the gripping and clamping member 10, the length of spring arm 20 is approximately twice that of fixing arm 11 and clamping arm 24 extends with its leading edge 25 roughly to the centre of the gripping and clamping member 10.

In one embodiment, the clamping length of clamping arm 24 corresponds to the entire width of the gripping and clamping member 10 and the width K oriented at right angles to the movement direction is approximately three times the length K' oriented in the direction of movement. Another embodiment described hereinafter has additional fixing members.

Figure 5:
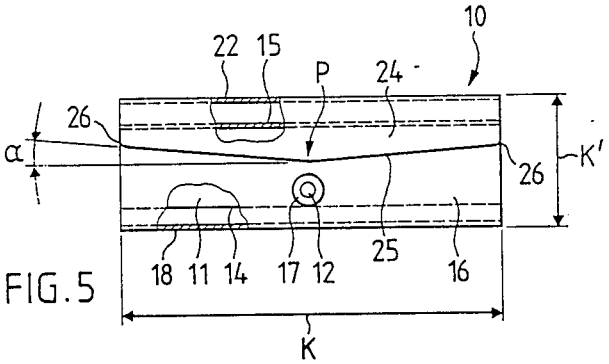
FIG. 5, the gripping and clamping member in plan view.

FIG. 5 shows the gripping and clamping member 10 in plan view and partly in cut open form, it being possible to see bearing arm 16 with opening 17, a portion of fixing arm 11 with opening 12 and clamping arm 24. The front edge 25 of clamping arm 24 which is rounded over the entire width K and which firstly engages with part B of a folded printed article, e.g. a newspaper D (FIG. 3) is chamfered at an acute angle a in such a way that a decision point P (decision peak) is frontally formed in the center of the clamping arm 24, is formed by a concave angle and can be engaged with the part B of newspaper D.

This decision point is used for the problem-free, clearly defined insertion of the product over its entire width into the opened gripping member 10. It is therefore possible to seize between the bundled pages or sheets of part B of a folded printed product, without any need to grip together all the sheets, i.e. the complete stack of sheets. The penetration of the concave sloping part between individual sheets, then "decides" at the very beginning the dividing of the stack into a seized part and a residual unseized part. In the outer region clamping arm 24 has well rounded edges 26 in the embodiment of FIG. 5. It is also possible to see portions of curved parts 18, 15, as well as a portion of fixing arm 11 and web 22.

Figure 6:
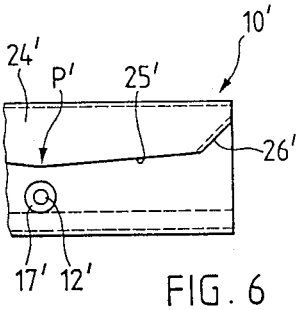
FIG. 6, in plan view a further embodiment of the gripping and clamping member.

FIG. 6 shows another embodiment of the gripping and clamping member 10', it being possible to see bearing arm 16', openings 12', 17', clamping arm 24' and leading edge 25'. Unlike in the embodiment according to FIG. 5, in this case the outer region of clamping arm 24' slopes downwards so that, as shown in FIG . 3, on either side is formed a claw-like clamping point 26' securing the printed product D. As a result of these additional fixing points to the clamping action of the clamping arm, a reliable fixing in the printed product plane which is torque-proof is obtained, which makes it possible to accelerate the printed product sideways and/or helically to a relatively significant extent. As a result higher conveying speeds can be adopted. Together with the aforementioned decision point, which neutralizes this additional penetration obstacle, an effective embodiment is obtained which improves the clamping apparatus without any hidden disadvantages.

Figure 7:
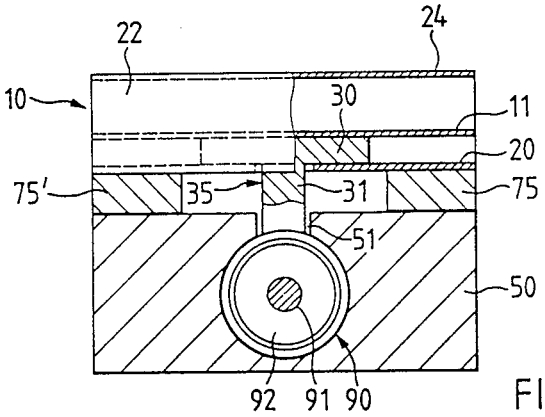
FIG. 7, a sectional view of the link chain arranged in a single-path guide rail with the gripping and clamping member fixed thereto.

FIG. 7 shows in side view the link chain 90 arranged and guided in a guide rail 50 constructed as a single chain channel and it is possible to see the support member 35 arranged on articulation 92 with a web 31 guided in a longitudinal slot 51 and fixed by not shown means. Support member 35 is provided with a correspondingly constructed bearing plate 30 operatively connected to fixing arm 11 for receiving and fixing the gripping and clamping member 10. On either side of web 31 are provided runner-like control members 75, 75' in guide rail 50, so that in the case of contacting thereof the springy parts 20, 22 and 24 of gripping and clamping member 10, as described in conjunction with FIG. 3, are raised from the closed position into the open position.

I claim:

1. An apparatus for gripping, conveying and releasing printed products comprising the combination of an endless link chain;

a support for said chain defining a path along which printed products are to be conveyed;

means for moving said chain along said path;

a plurality of gripping members attached at spaced points along said chain, each of said gripping members including a single piece of springy sheet metal bent around itself to form a spring member having adjacent portions relatively movable between an open position in which a gap is formed between said adjacent portions for encompassing part of a product and a closed, rest position in which the spring member urges the gap closed to engage and grasp the product; and means along said path for defining at least one pickup position at which product is to be grasped by the gripping members, said means including a control member having an inclined surface mounted to contact each spring member as said spring member approaches said pickup position and move the spring member to its open position to thereby encompass a part of a product, said control member having an abrupt end downstream for releasing said spring member to allow said spring member to grasp said product.

2. An apparatus according to claim 1 wherein said sheet metal is wound in a flattened, generally spiral shape so that said spring member comprises a generally C-shaped inner portion partially surrounded by a larger, generally C-shaped outer portion having a distal edge, said gap being defined between said distal edge and said inner portion, said spring member being biased so that, at rest, said gap is closed.

3. An apparatus according to claim 2 and including means for fixedly attaching said inner portion to a link of said link chain.

4. An apparatus according to claim 2 wherein said C-shaped outer portion includes an inner wall positioned to act as a limit stop to limit the extent of motion of product into said gap.

5. An apparatus according to claim 1 and including means along said path for defining at least one release position at which product is to be released by the gripping members, said means including a second control member having an inclined surface mounted to contact each spring member as said spring member approaches said release position and move said spring member to its open position to thereby disengage said product.

6. An apparatus according to claim 1 wherein, in each of said gripping members, said bent sheet metal forms a first generally flat portion attached to one link of said chain, a second generally flat portion connected to said first portion by a first bend of at least 180°, a third generally flat portion connected to said second portion by a second bend of less than 180° so that said first and third portions lie in planes having an acute angle therebetween, and a fourth generally flat portion connected to said third portion by an intervening bent portion having a total bend angle of about 180° and a bend radius larger than the radii of said first and second bends such that said fourth portion lies, at rest, across and in contact with said first bend, said third and fourth portions being movable together relative to said first bend and said second flat portion by flexing of said second bend to open and close said gap.

7. An apparatus according to claim 6 wherein said third and fourth flat portions are substantially parallel with each other.

8. An apparatus according to claim 7 wherein said fourth flat portion lies in contact with said first bend at the junction with said second flat portion.

9. An apparatus according to claim 6 wherein each said gripping member has a width perpendicular to the direction of motion of said link chain which is about three times the length of said gripping member measured in the direction of chain motion.

10. An apparatus according to claim 6 wherein said fourth flat portion terminates in a distal edge cut at an obtuse angle with the apex of said angle at the center of said edge.

11. An apparatus according to claim 10 wherein the outer side edges of said distal edge are bent downwardly for clamping teeth for engaging said product.

12. An apparatus according to claim 1 wherein each said gripping member has a width perpendicular to the direction of motion of said link chain which is about three times the length of said gripping member measured in the direction of chain motion.

* * * * *